US005566932A

United States Patent [19]

Hubbard

[11] Patent Number: 5,566,932

[45] Date of Patent: Oct. 22, 1996

[54] APPARATUS AND METHOD FOR DESKEWING SHEETS

[75] Inventor: David W. Hubbard, Stamford, Conn.

[73] Assignee: Pitney Bowes Inc., Stamford, Conn.

[21] Appl. No.: 306,286

[22] Filed: Sep. 15, 1994

[51] Int. Cl.[6] ..... B05H 9/04

[52] U.S. Cl. ..... 271/245; 271/254

[58] Field of Search ..... 271/245, 246, 271/254

[56] References Cited

U.S. PATENT DOCUMENTS

| | | | |
|---|---|---|---|
| 2,474,944 | 7/1949 | Henry | 271/2 |
| 3,072,397 | 1/1963 | Kelchner | 271/245 |
| 3,870,293 | 3/1975 | Simeth | 271/245 |
| 3,888,478 | 6/1975 | Alderman, Jr. et al. | 271/245 |
| 3,984,098 | 10/1976 | Stange et al. | 271/245 |
| 4,078,790 | 3/1978 | Stocker | 271/213 |
| 4,844,443 | 7/1989 | Trafton | 271/245 |
| 4,958,199 | 9/1990 | Yamashita et al. | 271/245 |
| 5,072,923 | 12/1991 | Coy | 271/118 |
| 5,094,443 | 3/1992 | Young, Jr. | 271/245 |
| 5,183,250 | 2/1993 | Miller et al. | 271/222 |
| 5,263,705 | 11/1993 | Schmaling | 271/246 |

FOREIGN PATENT DOCUMENTS

| | | | |
|---|---|---|---|
| 0147739 | 6/1988 | Japan | 271/245 |
| 1047743 | 6/1988 | Japan | 271/245 |
| 0043444 | 2/1989 | Japan | 271/245 |

*Primary Examiner*—H. Grant Skaggs
*Assistant Examiner*—T. Kelly
*Attorney, Agent, or Firm*—Ronald Reichman; Robert H. Whisker; Melvin J. Scolnick

[57] ABSTRACT

An apparatus and method for deskewing sheets as they are transported along a path. An intake roller assembly and an urged roller assembly are positioned along the path. The urge roller assembly bears upon a sheet with a forced selected so that the urge roller will slip if the sheet is blocked before the sheet is damaged. A rotatable element having a pair of stop elements in an upstream and a pair of deflecting elements at a downstream end is pivotable mounted beneath the path and rotates in a plane normal to the path, and is bias so that the deflecting elements intersect the path and the stop element are clear from the path. When the intake roller assembly drives a sheet against the deflecting elements the rotatable element rotates as the sheet rides over the deflecting element so that the stop elements intersect the path. If the sheet is skewed, that is if one edge is advanced, that edge will encounter the stop elements first. The urge roller assembly will then slip on the advanced side of the sheet while driving the other side forward until the sheet is deskewed. As the sheet is deskewed the deflecting elements are cleared and the rotatable element rotates to remove the stop elements from the path and the deskewed sheet continues for further processing. A pair of parallel guide plates are provided above and below the path to guide the sheet and increase its effective stiffness.

13 Claims, 3 Drawing Sheets

APPARATUS AND METHOD FOR DESKEWING SHEETS

BACKGROUND OF THE INVENTION

The subject invention relates to a method and apparatus for deskewing sheets as they are transported along a path. (By "sheets" herein is meant substantially planar, rectangular objects. ) More particularly the subject invention relates to a method and apparatus for deskewing sheets of paper, envelopes or completed mailpieces as they are transported through a mail production system.

As sheets such as envelopes or completed mailpieces are transported through various types of mail production equipment, such sheets will frequently become skewed. That is the sheets will be slightly rotated so that the leading and trailing edges of the sheets are no longer normal to the direction of the path along which these sheets are transported. Thus, such mail production systems frequently include one or more mechanisms for deskewing these sheets as they are transported. While such mechanisms have generally been satisfactory for their intended purpose they have also been relatively complex and expensive. Typically, such deskewing mechanisms would require a sensor which would generate a signal when a sheet approached the deskewing mechanism and some form of motor or actuator, responsive to the signal for driving a relatively complex, multi-element mechanism to deskew the sheet. Additionally, such mechanisms frequently required that the transport of the sheet be halted while the deskewing operation was carried out.

Thus, it is an object of the subject invention to provide a simple mechanism for deskewing sheets as they are transported along a path.

BRIEF SUMMARY OF THE INVENTION

The above object is achieved and the disadvantages of the prior art are overcome in accordance with the subject invention by means of an apparatus and method which includes an intake roller assembly and an urge roller assembly, which together define a path for transport of a sheet. A rotatable member having a pair of stop elements at a downstream end and a pair of deflecting elements at an upstream end is pivotably mounted proximate to the path for rotation in a plane normal to the path and biased so that the deflecting elements intersect the path and the stop elements are spaced from the path. The stop elements and the deflecting elements are each positioned along lines substantially normal to a direction of movement of the sheets along the path and substantially parallel to the path, and the downstream surfaces of the deflecting elements and upstream surfaces of the stop elements are separated by a distance approximately equal to, but not less than, the length of the sheets.

In accordance with one aspect of the subject invention the apparatus further includes a guide for constraining the sheets to a path to increase the effective stiffness of the sheets.

In accordance with the method of the subject invention as the intake roller assembly drives the sheets against the deflecting elements the presence of a sheet is mechanically sensed by the rotatable member which rotates as the sheet passes over the deflecting elements inserting the stop elements into the path of the sheet. As the sheet continues the urge roller assembly captures the sheet and continues to move it forward towards the stop elements. If the sheet is skewed the leading edge will reach one or the other of the stop element first. Because the urge roller assembly bears upon the sheet with a force which is sufficient to drive the sheet forward but allows slippage before the sheet is damaged when resistance is encountered, the urge roller assembly will continue to drive the lagging side of the sheet forward until the leading edge bears upon both stop elements and the sheet is deskewed. At the same time, the trailing edge of the sheet will clear the deflecting elements and the rotatable member will rotate back under the action of a bias force clearing the stop elements from the sheet path, allowing the sheet to continue.

DETAILED DESCRIPTION OF THE PREFERRED EMBODIMENTS OF THE SUBJECT INVENTION

Figure 1:
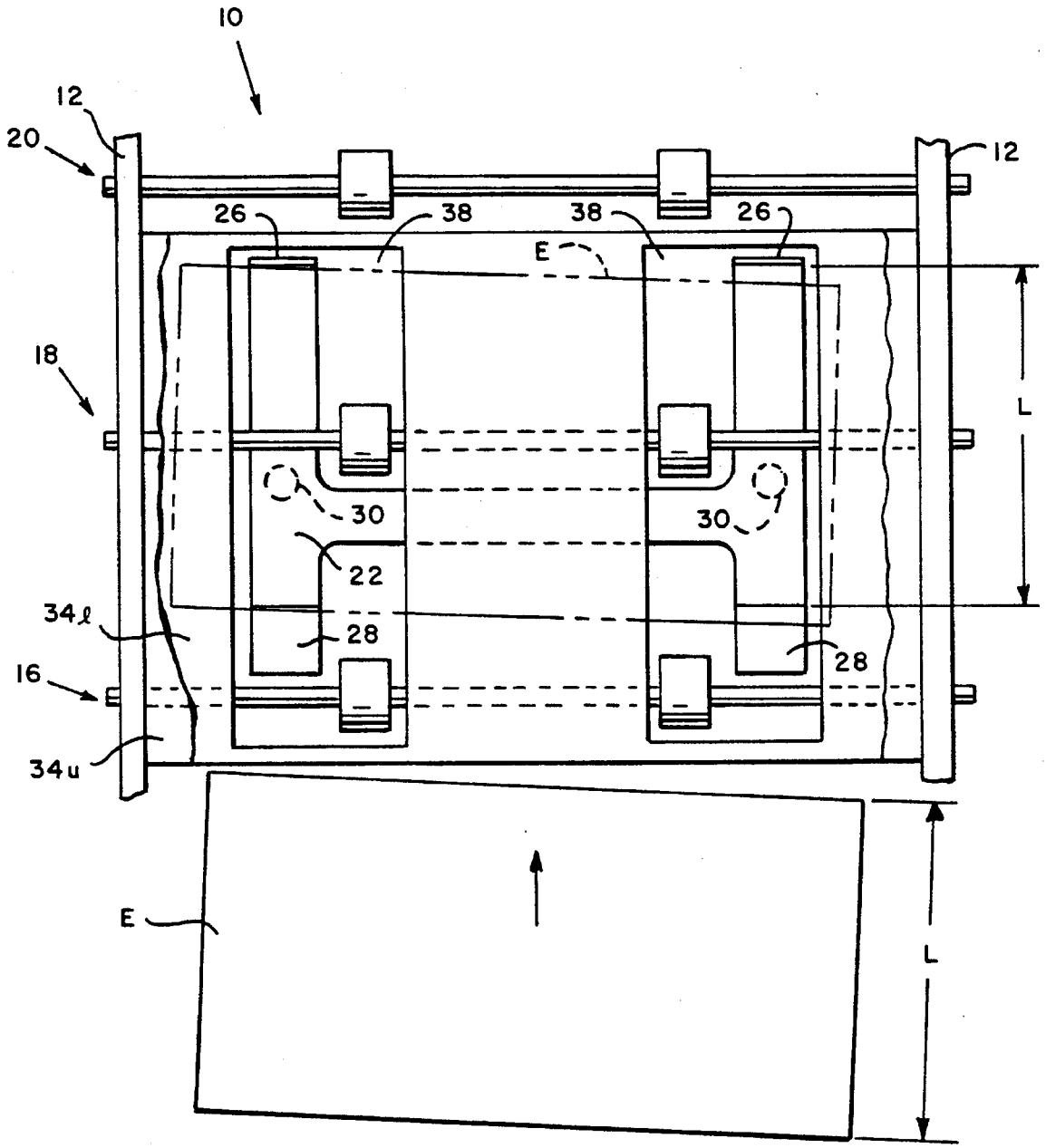
FIG. 1 is a top plan view, partially broken away, of an apparatus in accordance with the subject invention.

FIG. 1 shows a top plan view, partially broken away of apparatus for deskewing envelopes in accordance with a preferred embodiment of the subject invention.

A pair of spaced parallel walls 12 support intake roller assembly 16, urge roller assembly 18 and take-away roller assembly 20. Roller assemblies 16, 18 and 20 are driven by any suitable means (not shown) to drive envelope E along a path defined by the nips of each of roller assemblies 16, 18 and 20.

Roller assembly 18 is constructed in a conventional manner to bear upon envelope E with a force sufficient to drive it forward but which will allow slippage when resistance is encountered.

Rotatable member 22 is pivotably mounted to lower axle 18A (best seen in FIGS. 2 through 5) of urge roller assembly 18. Member 22 includes upstream stop elements 26 and downstream deflecting elements 28 and is biased by springs 30 so that deflecting elements 28 normally intersect the path and stop elements 26 normally are spaced from the path.

Apparatus 10 also includes a pair of substantial identical proximate, spaced, parallel plates 34*u* and 34 which together form a guide for constraining envelope E to move along the path defined by the nips of roller assemblies 16, 18 and 20; effectively increasing the stiffness of envelope E. Plates 34*u* and 34*l* are provided with openings 38 to allow roller assemblies 16, 18 and 20 and rotatable member 22 to bear upon envelope E.

Stop elements 26 and deflecting elements 28 are each positioned along lines which are substantially normal to the direction of motion of envelope E and parallel to the path. The upstream surface of stop elements 26 (i.e., the surface first encountered by the leading edge of envelope E) and the downstream surface of deflecting elements 28 (i.e., the surface last cleared by the trailing edge of envelope E) are separated by a distance L which is approximately equal to, but not less than, the length of envelope E.

Figure 2:
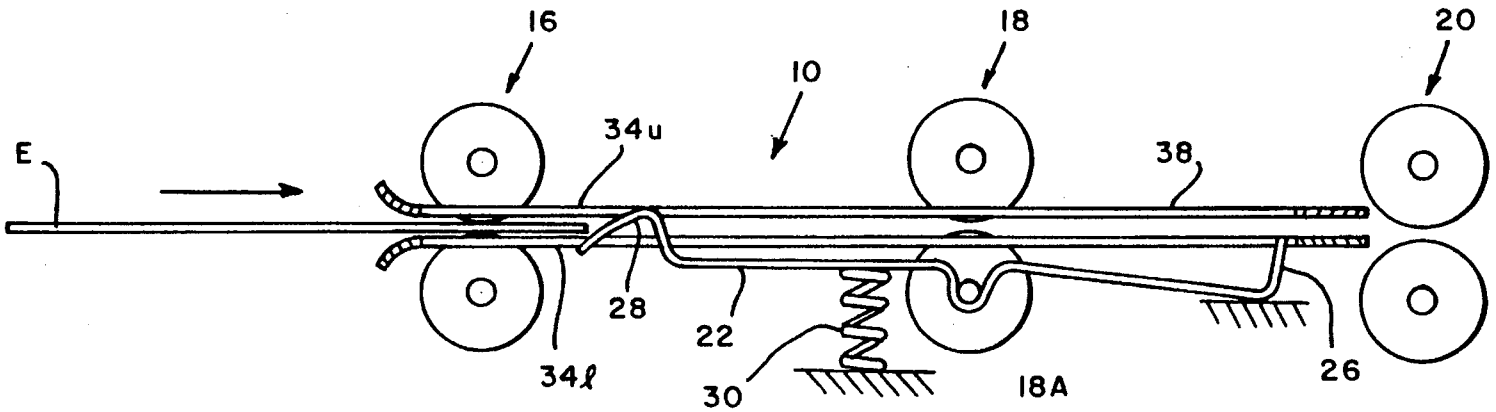
FIGS. 2 through 5 are semi-schematic side views of the apparatus of FIG. 1 showing the operation of the subject invention.
Figure 3:
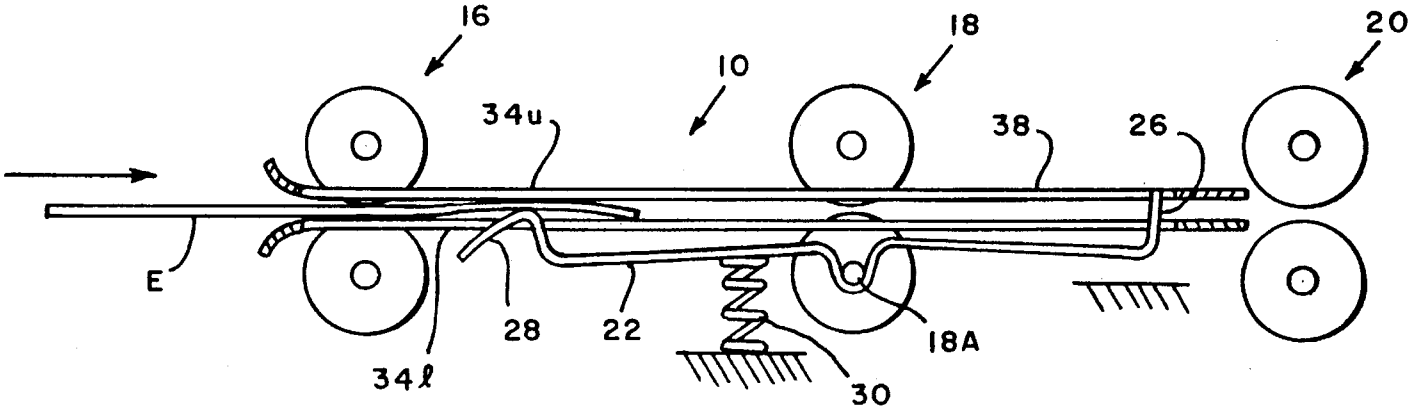
Figure 4:
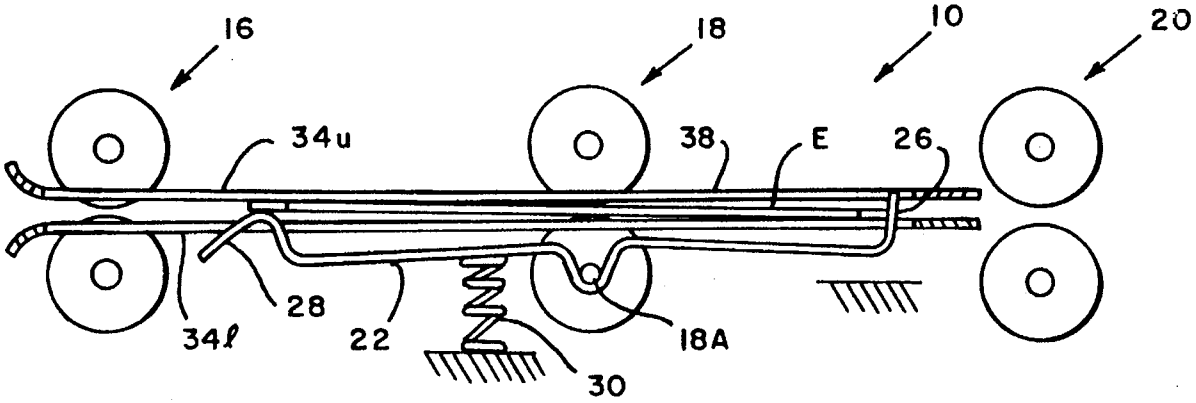
Figure 5:
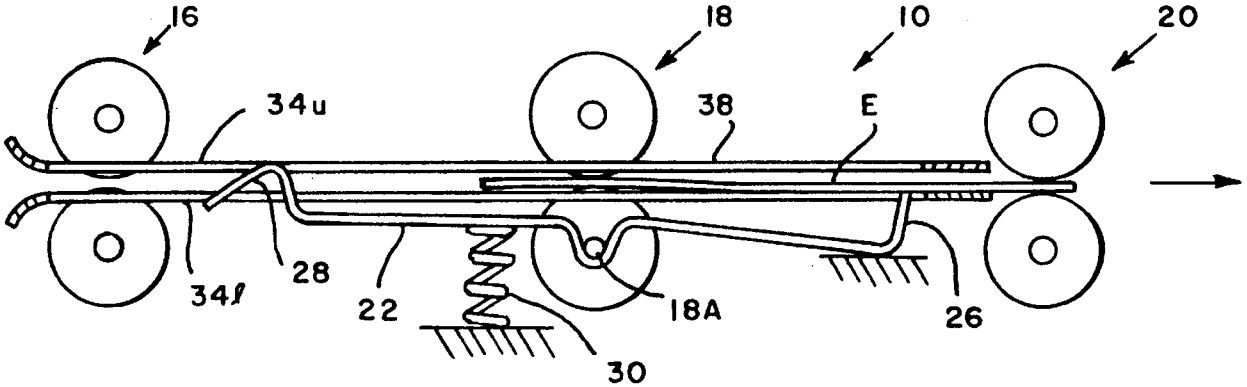

FIGS. 2 through 5 show a semi-schematic representation of apparatus 10 in deskewing envelope E. In FIG. 2 envelope E, which can be transported to this point by any suitable transport mechanism, is captured by intake roller assembly 16 and driven forward between guides 34*u* and 34*l* until the leading edge of envelope E is driven against deflecting elements 28. In FIG. 3, because of the sloped shaped of the downstream face of deflecting elements 28 and because of the inherent stiffness of envelope E, which is increased by the effect of guides 34*u* and 34, as intake roller assembly 16 continues to drive envelope E forward deflecting elements 28 will be deflected downwards out of the path of envelope E, pivoting rotatable member 22 about axle 18A, raising stop elements 26 to intersect the path. In FIG. 4 envelope E is captured by urge roller assembly and urged forward until the leading edge of envelope E bears upon at least one of stop elements 26. As can best be seen in phantom FIG. 1, if envelope E is skewed, i.e., if one side leads and one side lags with respect to the direction of movement the leading side will bear on one of elements 26 while the lagging side will still obstruct deflecting element 28 so that elements 26 will continue to obstruct the movement of envelope E. Because urge roller assembly 18 bears upon envelope E with a force selected to be sufficient to drive envelope E forward but to allow slippage before envelope E is damaged, urge roller assembly 18 will continue to drive the lagging side of envelope E forward while the leading side is obstructed, causing envelope E to pivot around the point where the leading edge of envelope E bears upon one of stops 26. Because the distance between stop elements 26 and deflecting elements 28 is approximately equal to, but not less than, length L of envelope E, as envelope E is deskewed the trailing edge will clear deflecting element 28 and springs 30 will rotate member 22 so that stop elements 26 are withdrawn from the path. As seen in FIG. 5 urge rollers 18 then continue to urge envelope E forward until envelope E is captured by take-away roller assembly 20 which drives envelope E on for further processing in any suitable manner.

The above detailed description and the attached drawings have been provided for purposes of illustration only, and those skilled in the art will recognize numerous other embodiments of the subject invention. Accordingly, limitations on the subject invention are to be found only in the claims set forth below.

What is claimed is:

1. An apparatus for deskewing sheets, comprising:

a) an intake roller assembly;

b) an urge roller assembly; and, c) a rotatable member having a pair of stop elements at a downstream end and a pair of deflecting elements at an upstream end; wherein, d) said intake roller assembly and said urge roller assembly define a path for transport of said sheets;

e) said rotatable member is pivotably mounted on a common axis with said urge roller assembly proximate to said path for rotation in a plane normal to said path and biased so that said deflecting elements intersect said path and said stop elements are spaced from said path;

f) said stop elements and said deflecting elements are each positioned along lines substantially normal to a direction of movement of said sheets along said path and substantially parallel to said path;

g) passage of said sheets over said deflecting elements rotates said member so that said stop elements intersect said path; and h) upstream surfaces of said deflecting elements and downstream surfaces of said stop elements are separated by a distance substantially equal to, but not less than, the length of said sheets.

2. An apparatus as described in claim 1, further comprising a guide for substantially constraining said sheet to move along said path, whereby the effective stiffness of said sheet is increased.

3. An apparatus as described in claim 2 wherein said guide comprises a pair of proximate, co-planar plates.

4. An apparatus as described in claim 1 wherein said rotatable member is spring biased.

5. An apparatus as described in claim 1 wherein said deflecting elements are substantially wedge shaped, having a sloping, upstream ramp surface and a substantially vertical downstream surface.

6. An apparatus as described in claim 1 further comprising a take-away roller assembly for transporting said sheet away from said apparatus.

7. An apparatus as described in claim 1 wherein said sheet is an envelope.

8. A method for deskewing a sheet comprising the steps of:

a) transporting said sheet along a path;

b) defining at least a pair of laterally spaced upstream points and laterally spaced downstream points in said path, said upstream points and said downstream points being separated by a distance approximately equal to the length of said sheet;

c) sensing the presence or absence of said sheet at said upstream points;

d) responding to the presence of said sheet at least one of said upstream points to insert stop elements into said path at said downstream points to bar transport of said sheet along said path, and to the absence of said sheet at all of said upstream points to withdraw said stop elements; and e) if said sheet is skewed so as to reach a first of said downstream points and bear upon a corresponding first of said stop elements said sheet is rotated about said first stop element by a torque applied to said sheet through an urge roller while still present at least one of said upstream points, rotating said sheet around said first stop element until said sheet is absent from all of said upstream points.

9. A method as described in claim 8 further comprising the step of constraining said sheet to a surface so as to increase the effective stiffness of said sheet.

10. A method as described in claim 9 wherein said surface is planar.

11. A method as described in claim 8 wherein said sensing step comprises rotational displacement of a biased H-shaped member by said sheet.

12. A method as described in claim 11 wherein said responding step comprises rotation of said H-shaped member to insert and withdraw said stop elements.

13. A method as described in claim 8 wherein said sheet is an envelope.

* * * * *